US012378766B2

(12) United States Patent
Pavel et al.

(10) Patent No.: US 12,378,766 B2
(45) Date of Patent: Aug. 5, 2025

(54) LOAD EQUALIZING SUPPORT SYSTEM FOR FAÇADE WALL PANELS

(71) Applicants: Robert Duane Pavel, Orlando, FL (US); Dean Overby Gwin, Jacksonville, FL (US); Bryant Ashley Luke, Ponte Vedra Beach, FL (US)

(72) Inventors: Robert Duane Pavel, Orlando, FL (US); Dean Overby Gwin, Jacksonville, FL (US); Bryant Ashley Luke, Ponte Vedra Beach, FL (US)

(73) Assignee: THE WELLS COMPANIES, INC., Albany, MN (US)

( * ) Notice: Subject to any disclaimer, the term of this patent is extended or adjusted under 35 U.S.C. 154(b) by 594 days.

(21) Appl. No.: 17/677,553

(22) Filed: Feb. 22, 2022

(65) Prior Publication Data

US 2022/0268020 A1 Aug. 25, 2022

Related U.S. Application Data

(60) Provisional application No. 63/207,296, filed on Feb. 22, 2021.

(51) Int. Cl.

| | |
|---|---|
| ***E04C 2/52*** | (2006.01) |
| ***E04B 2/00*** | (2006.01) |
| ***E04C 2/04*** | (2006.01) |
| ***E04C 2/38*** | (2006.01) |

(52) U.S. Cl.

CPC ..... *E04C 2/526* (2013.01); *E04C 2/044* (2013.01); *E04C 2/38* (2013.01); *E04C 2/46* (2013.01)

(58) Field of Classification Search

CPC . E04C 2/526; E04C 2/044; E04C 2/38; E04C 2/46; E04C 2/384; E04C 2/48

See application file for complete search history.

(56) References Cited

U.S. PATENT DOCUMENTS

| | | | | | |
|---|---|---|---|---|---|
| 1,226,179 | A * | 5/1917 | Bommer | E05F 1/1215 | 16/280 |
| 3,769,774 | A * | 11/1973 | Barnes | F16L 3/14 | 52/39 |
| 4,007,563 | A * | 2/1977 | Nakagawa | E04D 3/3606 | 52/378 |
| 4,513,939 | A * | 4/1985 | Berger | F24F 13/32 | 52/27 |
| 5,568,711 | A * | 10/1996 | Popp | E01B 9/10 | 52/707 |
| 6,959,902 | B2 * | 11/2005 | Leahy | F16B 2/005 | 248/548 |

(Continued)

*Primary Examiner* — Babajide A Demuren

(74) *Attorney, Agent, or Firm* — Sheridan Ross P.C.

(57) ABSTRACT

Systems, methods, and an apparatus are provided for supporting a wall panel on a floor surface and for providing a desired distribution of a load from the wall panel to the floor surface. For some buildings, the desired distribution is an equal or uniform distribution. A wall panel such as a precast concrete façade wall panel may include multiple supports that contact a floor surface. Each support has a bias member that generates a force that is equivalent to the portion of the overall load that the support transfers to a floor. As a result, bias members in these supports can be adjusted to provide a desired load distribution from a wall panel or other component to the floor surface to account for floor deflection, settling of the building, spanning adjacent columns, etc.

19 Claims, 6 Drawing Sheets

(56) References Cited

U.S. PATENT DOCUMENTS

| | | | | |
|---|---|---|---|---|
| 10,961,739 | B2 * | 3/2021 | Lee | E04H 9/021 |
| 11,002,005 | B2 * | 5/2021 | Hwang | E04B 1/415 |
| 2006/0156657 | A1 * | 7/2006 | Commins | F16B 5/0266 52/223.13 |
| 2007/0227082 | A1 * | 10/2007 | Morton | E04G 23/0218 52/127.2 |
| 2008/0072508 | A1 * | 3/2008 | Tower | F16F 1/12 52/223.13 |

* cited by examiner

LOAD EQUALIZING SUPPORT SYSTEM FOR FAÇADE WALL PANELS

CROSS-REFERENCE TO RELATED APPLICATION

This application claims priority and benefits under 35 U.S.C. § 119(e) to U.S. Provisional Patent Application Ser. No. 63/207,296 filed on Feb. 22, 2021, which is incorporated herein in its entirety by reference.

FIELD

The present disclosure relates generally to systems, methods, and an apparatus for equalizing a load from a façade wall panel to a floor surface.

BACKGROUND

Buildings may incorporate façade wall panels to enclose an interior space of the building and protect the interior space from negative aspects of the external environment such as extreme weather. These façade wall panels may also distribute a load to a floor surface within the building. For instance, a façade wall panel made from precast concrete may be 4 to 12 inches thick depending on the span and loading conditions, which creates a stiff and heavy panel with a resulting load that needs to be properly distributed to a floor surface.

Typically, only two supports are used to join a façade wall panel to a floor surface due to the stiffness of the panels. Specifically, if more than two supports are used, then the analysis for distributing the load to the floor surface will become indeterminate and cannot be predicted well. This is crucial because the floor surface is expected to receive the load in a certain manner and deflect in some instances. Unexpected loads and deflections can have catastrophic consequences in a building. With only two supports, the distribution of the load from the façade wall panel to the floor surface is more predictable.

Façade wall panels may also be used to retrofit or reclad an existing building. An existing building may not be designed for higher loads and may require loads to be evenly distributed to the floor surface between columns. However, a façade wall panel with a rigid frame may span such a distance but may not provide the desired distribution of a load to the floor surface. In addition, an existing building may have experienced some settling over time or buildings can move due to earthquakes, hurricanes, and other events that affect the building, which complicates recladding an existing building with façade wall panels. Moreover, modern techniques allow precast concrete panels to be thinner and lighter with longer spans and rigid frames in some instances. However, if a façade wall panel or a frame is not sufficiently rigid or too flexible, then the use of additional supports, sometimes more than two supports, may be necessary to properly distribute the load. Therefore, there is a need to adjust the distribution of a load from a panel to a floor.

SUMMARY

One aspect of the present disclosure is to provide a system, a method, and an apparatus for distributing a load from a façade wall panel to a floor surface. A plurality of adjustable supports can be connected to a façade wall panel and/or a frame of the panel where each support has a coupler that contacts a floor surface. Each support can be individually adjusted to change the amount of force, and thus the portion of the overall load, that the coupler transfers to the floor surface. These supports and forces can be adjusted to provide the desired distribution of a load from a façade wall panel to a floor surface.

It is another aspect of the present disclosure to provide a support with an adjustable bias member such as a spring. In some embodiments, a coupler is operably connected to a spring where selective compression of the spring adjusts the force that the coupler transfers to the floor surface. According to Hooke's Law, the force generated by a spring is equal to the displacement of the spring multiplied by a spring constant. Thus, the spring can be compressed to increase the force or expanded to decrease the force transferred to the floor surface. In various embodiments, the spring is positioned between two plates, and the coupler is connected to one plate. As a plate is moved, the spring is compressed or expanded, and the resulting force is adjusted.

It is a further aspect of the present disclosure to provide a support with an adjustment feature. In some embodiments, the adjustment feature is a bolt that moves a plate to compress a bias member such as a spring. The bias member can be positioned between two plates within a housing to limit movement of the spring and these plates to a longitudinal direction, which is typically oriented vertically to transfer a load through the coupler to a floor surface. While the plates around the bias member are moveable, a further bolt plate can be connected to the housing such that the bolt plate does not move. Optionally, the bolt plate is simply fixed in place relative to the housing. The bolt is threadably engaged to an aperture in the bolt plate, and a distal end of the bolt is configured to contact one of the moveable plates around the bias member. Thus, as the bolt extends through the bolt plate, the bolt compresses the bias member to increase a resulting force. Conversely, as the bolt retracts through the bolt plate, the bolt allows the bias member to expand and decrease the resulting force. In a panel with a plurality of supports, the bolts for the supports can be adjusted as needed to produce a desired distribution of the load from the panel to the floor surface.

It is yet another aspect of embodiments of the present disclosure to provide a façade wall panel with a plurality of supports. The plurality can include any number of supports including two, three, four, etc. supports. In some embodiments, the floor surface is characterized to account for the expected span, position between columns, any settling of the floor surface, etc. Then, supports are adjusted to provide a desired distribution as described herein, and the façade wall panel is installed. In some embodiments, the supports can be further adjusted after installation to provide a final disposition for the supports and the distribution of the load from the façade wall panel to the floor surface. Moreover, the supports can be adjusted in the future to accommodate any changes to the building such as further settling. It will be appreciated that while the terms uniform and non-uniform distribution are used herein, in some instances, a proper distribution may not be uniform. Thus, the adjustment of the supports may be described as changing a first load distribution to a second load distribution, or an initial load distribution to a final load distribution.

While embodiments of the present disclosure are described with respect to precast concrete façade wall panels, it will be appreciated that the adjustable supports have a broad range of applicability in a wide range of industries. Accordingly, adjustable supports can be used for other panels beyond façade wall panels and for any other type of material beyond precast concrete. Moreover, the adjustable supports can be used in any application where modifying the distribution of a load is desirable, or even adjusting the load force for any type of distribution is desirable.

A first aspect of the present disclosure is to provide an apparatus connected to a wall panel for adjusting a force against a floor surface, comprising a housing defining an interior volume and having an upper opening and a lower opening; a bias member positioned within the interior volume between an upper plate of an upper assembly and a lower plate of a lower assembly; a coupler of the lower assembly connected to the lower plate, wherein the coupler passes through the lower opening to contact the floor surface; and a bolt of the upper assembly that contacts the upper plate, wherein rotation of the bolt in a first direction moves the upper plate and compresses the bias member to increase the force transferred from the coupler to the floor surface, and rotation of the bolt in an opposing second direction moves the upper plate and expands the bias member to decrease the force transferred by the coupler to the floor surface.

In some embodiments, the bias member is a spring having one of a linear response or a non-linear response.

The apparatus of the first aspect may include one or more of the previous embodiments and a bolt plate connected to the housing and covering the upper opening, wherein the bolt is threadably engaged to an aperture through the bolt plate so that the bolt can rotate in the first direction or the second direction.

Optionally, the apparatus of the first aspect comprises a first component threadably engaged to a second component, and relative rotation between the first and second components adjusts a length of the coupler and moves the lower plate within the housing.

Optionally, the housing may include one or more slots formed through a sidewall of the housing. The one or more slots are configured to permit visual inspection of the positions of one or more of the upper plate and the lower plate. In some embodiments, a first slot is located proximate to the upper plate and a second slot is located proximate to the lower plate. In further embodiments, the one or more slots are configured to provide the ability to visually inspect the positions of one or more of the bolt, the upper plate, lower plate, and the position of the coupler relative to the frame or housing.

In some embodiments, the housing has a rectangular cross-section with four inner walls, and the upper plate and the lower plate each have four outer walls that complement the four inner walls of the housing.

The apparatus of the first aspect may include one or more of the previous embodiments and wherein the upper plate and the lower plate each have chamfers at corners between adjacent outer walls to reduce binding with the four inner walls of the housing.

Optionally, the apparatus may have a guide that extends from a bottom surface of the upper plate and into the bias member to locate the bias member relative to the upper plate.

A second aspect of the present disclosure is to provide a system for distributing a load from a vertically-oriented wall panel to a floor surface, comprising a plurality of supports connected to the wall panel, each support having: a bias member positioned within a housing, wherein the bias member generates a force equal to a portion of the load; a coupler operably connected to the bias member, wherein the coupler contacts the floor surface to transfer the portion of the load to the floor surface; and an adjustment feature that changes the force generated by the bias member to change the portion of the load transferred to the floor surface.

In some embodiments, the plurality of supports comprises at least three supports, and at least two supports of the plurality of supports transfer distinct portions of the load to the floor surface.

In addition or alternatively, the plurality of supports comprises at least three supports, and at least two supports of the plurality of supports transfer equal portions of the load to the floor surface.

In addition or alternatively, the bias members of the supports of the plurality of supports are adjusted such that the load from the wall panel is uniformly distributed to the floor surface.

In some embodiments, the system further comprises a frame connected to the wall panel, wherein the plurality of supports is connected to the frame, and the coupler of each support in the plurality of supports extends through a horizontal member of the frame to contact the floor surface.

Optionally, the adjustment feature is a bolt that is threadably engaged with an aperture, and the bolt contacts an upper plate positioned at a top end of the bias member.

In some embodiments, the bias member is one of a spring, a hydraulic actuator, a pneumatic actuator, or an electric actuator.

A third aspect of the present disclosure is to provide a method for distributing a load from a wall panel against a floor surface, comprising providing the wall panel with a plurality of supports, wherein each support has a coupler that extends to contact the floor surface; positioning a bias member between an upper and a lower plate of each support of the plurality of supports, wherein the coupler is connected to the lower plate, and the bias member generates a force equal to a portion of the load transferred to the floor surface through the coupler; determining a distribution of the load from the wall panel to the floor surface based on a characteristic of the floor surface; and moving the upper plate relative to the lower plate of at least one support of the plurality of supports to change a displacement of the bias member and adjust the force generated by the bias member to meet the determined distribution of the load.

In some embodiments, the method further comprises rotating a bolt relative to a bolt plate of a support of the plurality of supports to move the upper plate relative to the lower plate.

Optionally, the method may further comprise fixing a position of the bolt relative to the bolt plate of the support of the plurality of supports to maintain the force generated by the bias member.

Further optionally, the method may further comprise rotating a first component of the coupler of a support of the plurality of supports relative to a second component of the coupler to change a length of the coupler and to change a position of the lower plate.

In some embodiments, the method may further comprise connecting at least three supports of the plurality of supports to the wall panel, wherein at least two supports transfer distinct portions of the load.

In addition or alternatively, the method may further comprise connecting at least three supports of the plurality of supports to the wall panel, wherein at least two supports transfer equal portions of the load.

The Summary is neither intended nor should it be construed as being representative of the full extent and scope of the present disclosure. The present disclosure is set forth in various levels of detail in the Summary as well as in the attached drawings and the Detailed Description and no limitation as to the scope of the present disclosure is intended by either the inclusion or non-inclusion of elements or components. Additional aspects of the present disclosure will become more readily apparent from the Detailed Description, particularly when taken together with the drawings.

The above-described embodiments, objectives, and configurations are neither complete nor exhaustive. As will be appreciated, other embodiments of the disclosure are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

The term "a" or "an" entity, as used herein, refers to one or more of that entity. As such, the terms "a" (or "an"), "one or more" and "at least one" can be used interchangeably herein.

Unless otherwise indicated, all numbers expressing quantities, dimensions, conditions, ratios, ranges, and so forth used in the specification and claims are to be understood as being modified in all instances by the term "about" or "approximately". Accordingly, unless otherwise indicated, all numbers expressing quantities, dimensions, conditions, ratios, angles, ranges, and so forth used in the specification and claims may be increased or decreased by approximately 5% to achieve satisfactory results. Additionally, where the meaning of the terms "about" or "approximately" as used herein would not otherwise be apparent to one of ordinary skill in the art, the terms "about" and "approximately" should be interpreted as meaning within plus or minus 10% of the stated value.

Unless otherwise indicated, the term "substantially" indicates a different of from 0% to 5% of the stated value is acceptable.

All ranges described herein may be reduced to any sub-range or portion of the range, or to any value within the range without deviating from the invention. For example, the range "5 to 55" includes, but is not limited to, the sub-ranges "5 to 20" as well as "17 to 54."

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description, Abstract, and Claims themselves.

BRIEF DESCRIPTION OF THE DRAWINGS

The accompanying drawings, which are incorporated in and constitute a part of the specification, illustrate embodiments of the disclosed system and together with the general description of the disclosure given above and the detailed description of the drawings given below, serve to explain the principles of the disclosed system(s) and device(s).

Figure 1A:
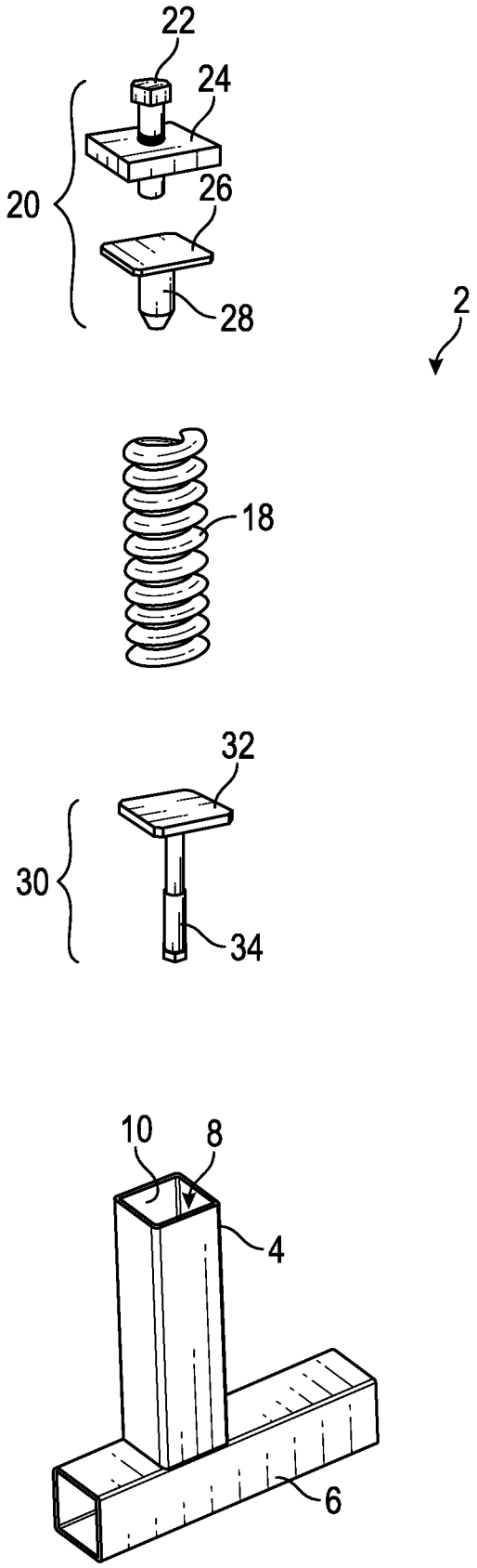
FIG. 1A is an exploded, perspective view of a support in accordance with an embodiment of the present disclosure.

The drawings are not necessarily (but may be) to scale. In certain instances, details that are not necessary for an understanding of the disclosure or that render other details difficult to perceive may have been omitted. It should be understood, of course, that the disclosure is not necessarily limited to the embodiments illustrated herein. As will be appreciated, other embodiments are possible using, alone or in combination, one or more of the features set forth above or described below. For example, it is contemplated that various features and devices shown and/or described with respect to one embodiment may be combined with or substituted for features or devices of other embodiments regardless of whether or not such a combination or substitution is specifically shown or described herein.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

The following is a listing of components according to various embodiments of the present disclosure, and as shown in the drawings:

| Number | Component |
|---|---|
| 2 | Support |
| 4 | Housing |
| 6 | Frame |
| 8 | Interior Volume |
| 10 | Upper Opening (Housing) |
| 12 | Lower Opening (Housing) |
| 14 | Upper Opening (Frame) |
| 16 | Lower Opening (Frame) |
| 18 | Bias Member |
| 20 | Upper Assembly |
| 22 | Bolt |
| 24 | Bolt Plate |
| 26 | Upper Plate |
| 28 | Guide |
| 30 | Lower Assembly |
| 32 | Lower Plate |
| 34 | Coupler |
| 36 | Vertical Member |
| 38 | Floor Surface |

-continued

| Number | Component |
|---|---|
| 40 | Axis |
| 42 | Rotation Direction |
| 44 | First Distance |
| 46 | Second Distance |
| 48 | Third Distance |
| 50 | Wall Panel |
| 52 | First Threaded Surface |
| 54 | Second Threaded Surface |
| 55 | Lock |
| 56 | Chamfered Corner |
| 58 | Tapered End |
| 60 | First End |
| 62 | Second End |
| 64 | Chamfered Corner |
| 66 | First Bolt |
| 68 | Collar |
| 70 | Second Bolt |
| 72 | Providing Wall Panel |
| 74 | Determining Load Distribution |
| 76 | Adjusting Bias Member |
| 78 | Installing Wall Panel |
| 80 | Further Adjusting Bias Member |

DETAILED DESCRIPTION

The present disclosure has significant benefits across a broad spectrum of endeavors. It is the Applicant's intent that this specification and the claims appended hereto be accorded a breadth in keeping with the scope and spirit of the disclosure being disclosed despite what might appear to be limiting language imposed by the requirements of referring to the specific examples disclosed. To acquaint persons skilled in the pertinent arts most closely related to the present disclosure, a preferred embodiment that illustrates the best mode now contemplated for putting the disclosure into practice is described herein by, and with reference to, the annexed drawings that form a part of the specification. The exemplary embodiment is described in detail without attempting to describe all of the various forms and modifications in which the disclosure might be embodied. As such, the embodiments described herein are illustrative, and as will become apparent to those skilled in the arts, may be modified in numerous ways within the scope and spirit of the disclosure.

Although the following text sets forth a detailed description of numerous different embodiments of panels and supports, it should be understood that the detailed description is to be construed as exemplary only and does not describe every possible embodiment since describing every possible embodiment would be impractical, if not impossible. Numerous alternative embodiments can be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Figure 1B:
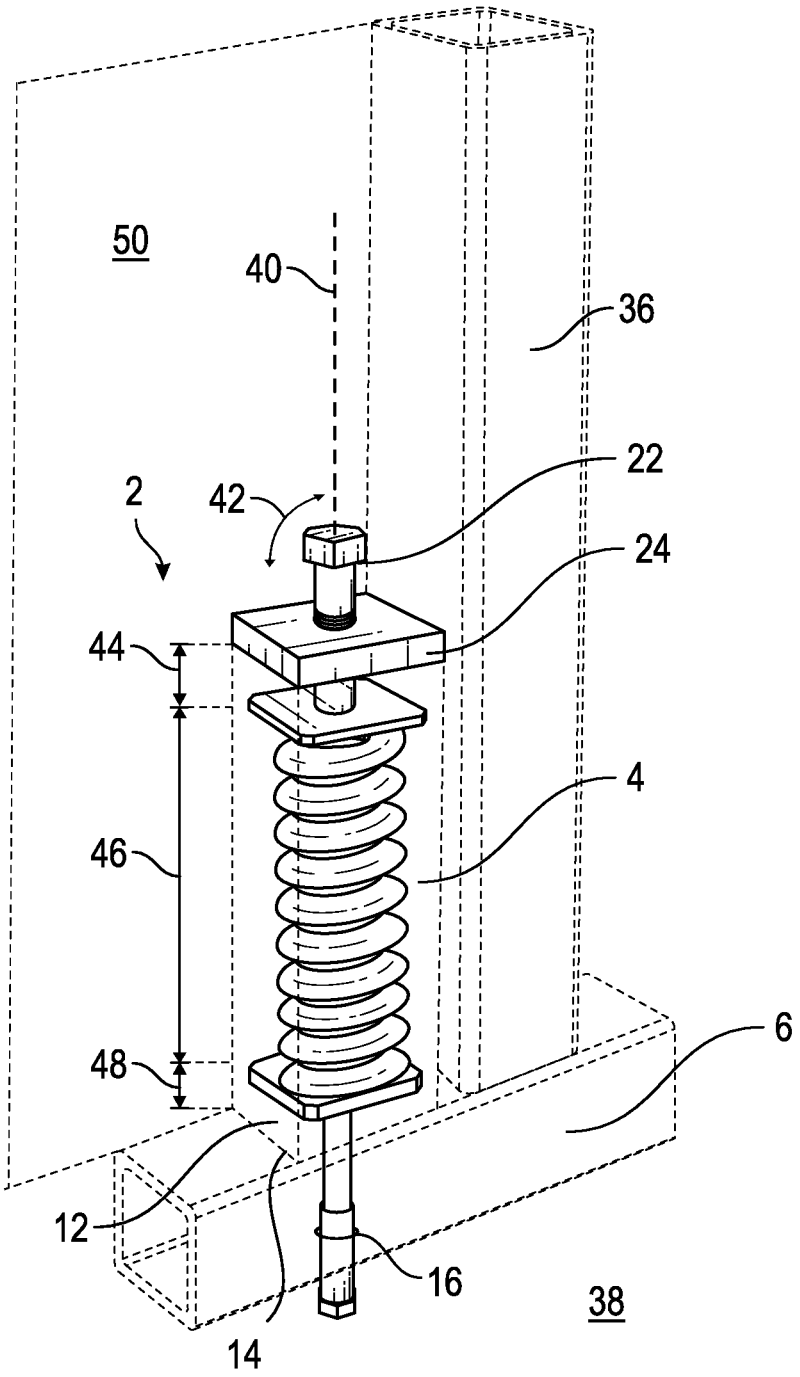
FIG. 1B is a transparent, perspective view of the support in FIG. 1A secured to a frame and a wall panel in accordance with an embodiment of the present disclosure.

Referring now to FIGS. 1A and 1B, an exploded, perspective view and an assembled, perspective view of a support 2 are provided, respectively. More specifically, the exploded view in FIG. 1A shows each component of the support 2, and the view in FIG. 1B is partially transparent to show the relationship between components in an assembled state. As discussed herein, in some embodiments, the façade wall panel has a frame 6 to support and/or provide rigidity to a thinner panel. However, it will be appreciated that in some embodiments, the support 2 can be directly connected to a wall panel and/or other component.

A housing 4 encloses several of the components of the support 2. The housing 4 can be made from a metal material and have a rectangular cross section, but the housing 4 is not limited to this material and this cross section. For instance, the housing 4 can be made from a fiber composite material and have a circle or oval cross section. In the embodiment depicted in FIGS. 1A and 1B, the housing 4 is the same material as the frame 6, and the housing 4 defines an interior volume 8 that has an upper opening 10 and a lower opening 12. The portion of the frame 6 below the housing 4 also has an upper opening 14 and a lower opening 16 to accommodate a coupler 34 extending from the bottom of the support 2 as described in detail herein.

Next, the support 2 generally comprises a bias member 18 that generates a force equivalent to the portion of the overall load that the support 2 transfers to a floor surface. The bias member 18 is positioned between an upper assembly 20 and a lower assembly 30, specifically, between an upper plate 26 of the upper assembly 20 and a lower plate 32 of the lower assembly 30. The upper plate 26 has a guide 28 that extends from a bottom surface and into the bias member 18 to overlap at least one turn of the bias member 18 and to locate the bias member 18 relative to the upper plate 26.

A bolt 22 is rotatably connected to a bolt plate 24 such that rotation 42 of the bolt 22 within a threaded aperture of the bolt plate 24 causes the bolt to move along a longitudinal axis 40. In a first rotational direction, the bolt 22 moves downward and moves the upper plate 26 downward to compress the bias member 18. In a second, opposing rotational direction, the bolt 22 moves upward and moves the upper plate 26 upward to expand the bias member 18. To accomplish this, the bolt plate 24 is fixed in place and the upper plate 26 and the bias member 18 are allowed to move relative to the bolt plate 24. As shown in FIG. 1B, the bolt plate 24 is connected to the housing 4 to cover the upper opening 10 of the housing 4. This connection can be, for example, a welded connection, threaded connection, etc. With this arrangement, the top end of the bolt 22 is accessible from outside of the support 2, and thus, the bolt 22 can be engaged and rotated to change the force generated by the bias member 18.

It will be appreciated that the bolt 22 can have other orientations. For instance, to provide improved access to the bolt 22, the bolt 22 may be oriented perpendicular to the longitudinal axis 40. In these embodiments, the bolt 22 may drive a gear that translates rotational movement of the bolt to longitudinal movement of the upper plate 26. In some embodiments, the housing 2 has no upper opening 10 and instead has an enclosed upper end.

In a similar vein, in some embodiments, the housing 4 and other components of the support 2 are encased in the wall panel. A feature such as a void former can be positioned in a mold during a pouring sequence to create a precast wall panel, and the void former excludes part of the concrete to provide access to, for example, the bolt 22. Thus, the bolt 22 can be rotated and the support 2 can be adjusted even when the housing 4 is at least partially positioned in a wall panel. It will be appreciated that in some embodiments the housing 4 is connected to a frame, which is then affixed to the wall panel after the pouring sequence.

The lower assembly 30 generally comprises a lower plate 32 and a coupler 34 extending from a bottom surface of the lower plate 32. The coupler 34 in this embodiment extends from the support 2, passes through the frame 6, and contacts a floor surface 38 to impose a force on the floor surface 38, and therefore, transfer part of a load from the wall panel 50 to the floor surface 38. The coupler 34 is adjustable in length to aid in the overall adjustability of the support 2.

Referring to FIG. 1B, the support 2 is assembled with the upper plate, the bias member, and the lower plate confined within the interior volume 8 of the housing 4. The upper and lower plates as well as the bias member are allowed to move along the longitudinal axis 40. Various dimensions 44, 46, 48 are arrayed along the longitudinal axis 40. A first dimension 44 is between the bolt plate 24 and the upper plate, a second dimension 46 is between the upper plate and the lower plate, and a third dimension 48 is between the lower plate and a lower opening 12 of the housing 4. The length of the coupler can be adjusted to change the third dimension 48. In some embodiments, the third dimension 48 is greater than zero such that the lower plate is not resting on the frame, which would render the support 2 non-adjustable. Next, the bolt 22 can be rotated within the bolt plate 24 to change the first dimension 44 by a predetermined distance. This, in turn, changes the second dimension 46 and the third dimension 48. In one example, the bolt 22 rotates and moves the upper plate, which increases the first dimension 44 by a first distance. Then, the second dimension 46 decreases by a second distance to compress the bias member. As a result, the bias member generates an additional force equal to the second distance multiplied by the spring constant associated with the bias member. This force is transferred through the coupler to the floor surface 38. In some embodiments, the first and second distances are equal, and in other embodiments, the first and second distances are distinct.

Figure 2:
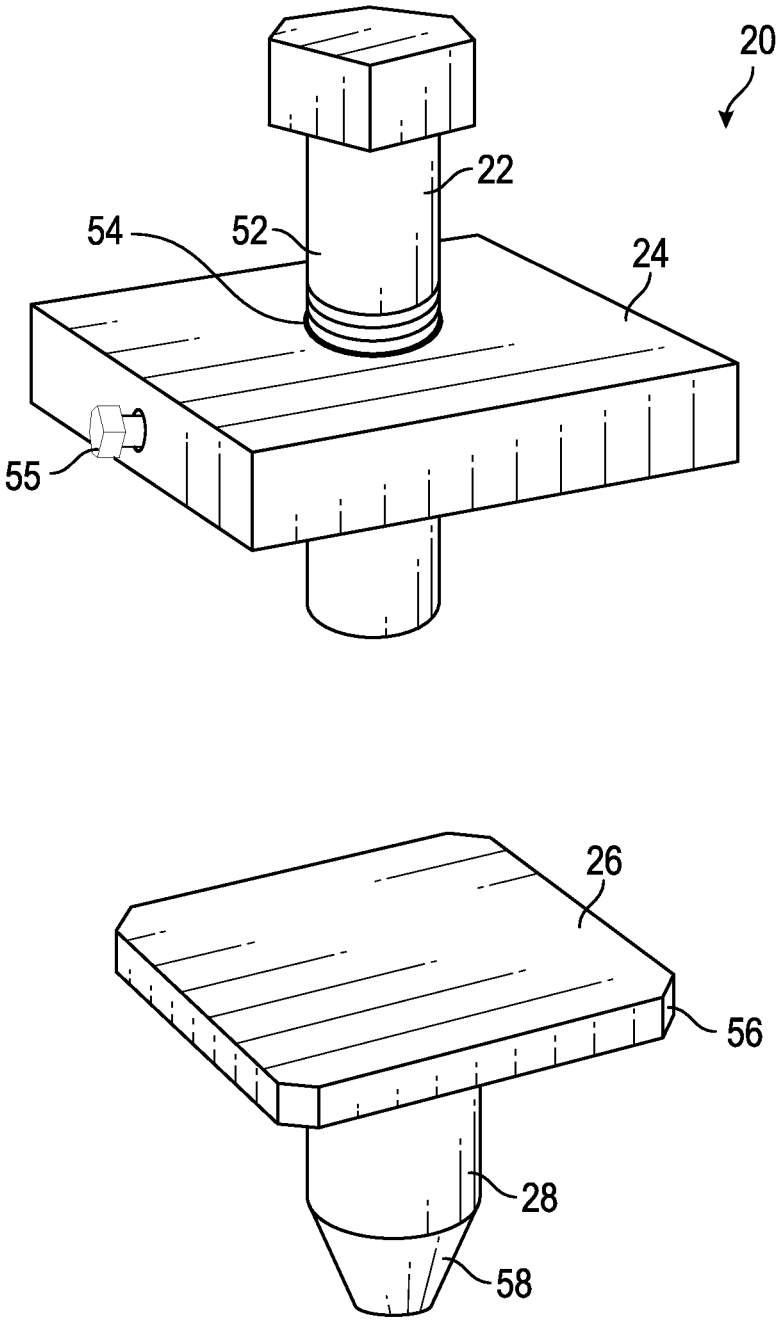
FIG. 2 is a perspective view of an upper assembly of the support in FIG. 1A in accordance with an embodiment of the present disclosure.

Referring now to FIG. 2, a perspective view of the upper assembly 20 is provided. The bolt 22 has a threaded outer surface 52 along a portion the shaft of the bolt 22, and the bolt plate 24 has a threaded aperture 54 that the bolt 22 engages. Thus, as the bolt 22 rotates in one direction the bolt 22 extends through the bolt plate 24 in one longitudinal direction, and as the bolt 22 rotates in an opposing direction the bolt 22 extends through the bolt plate 24 in an opposing longitudinal direction. The upper plate 26 has a guide 28 that extends from a bottom surface of the plate 26, and the guide 28 has a tapered distal end 58 to promote in the initial assembly with the bias member.

Optionally, a lock 55 may hold the position of the bolt 22 within the bolt plate 24. As discussed herein, the bolt 22 may be moved to change the disposition of a bias member as well as the force transferred through the coupler of the support and to a floor surface. Once in a final position, the bolt 22 may be locked in place to prevent the unintentional movement of the bolt, and thus, the unintentional change of the force generated by the bias member. The lock 55 may be a set screw that extends through the bolt plate 24 in a direction other than longitudinal to physically impinge upon the bolt 22. In other embodiments, the lock 55 is a detent or ratchet component that can hold the position of the bolt 22.

In addition, the corners between adjacent outer walls may include a chamfer 56 to prevent binding within the housing as the upper plate 26 moves longitudinally within the housing. It will be appreciated that the outer walls of the upper plate 26 generally complement the inner walls of the housing and can include a coating to reduce the friction with the inner walls of the housing. The cross sectional shape of the upper plate 26 may be substantially the same as the cross sectional shape of the interior of the housing, though the upper plate 26 can be smaller to promote movement within the housing. Moreover, the upper plate 26 complements the housing in that at least a portion of an outer wall of the upper plate 26 matches at least a portion of a corresponding inner wall of the housing to allow for the addition of chamfers 56.

Figure 3:
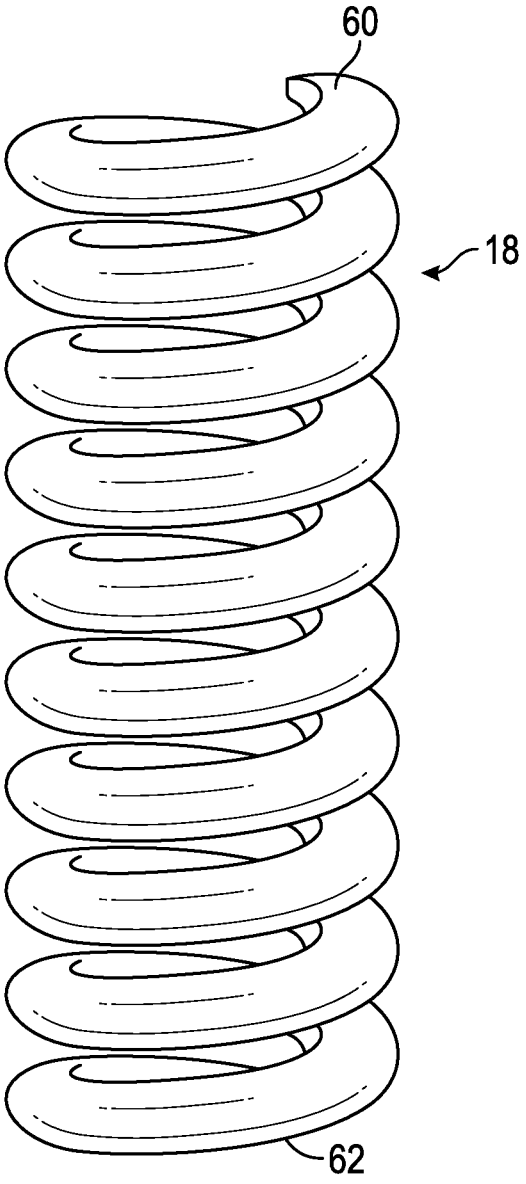
FIG. 3 is a perspective view of a bias member of the support in FIG. 1A in accordance with an embodiment of the present disclosure.

Referring now to FIG. 3, a perspective view of a bias member 18 is provided. The bias member 18 in this embodiment is a spring that extends between a first end 60 and a second end 62. The spring can have a linear or non-linear response to displacement. Further still, the bias member 18 is not limited to only springs. The bias member 18 can be a hydraulic actuator, a pneumatic actuator such as an air cushion, an electric actuator, etc.

Figure 4:
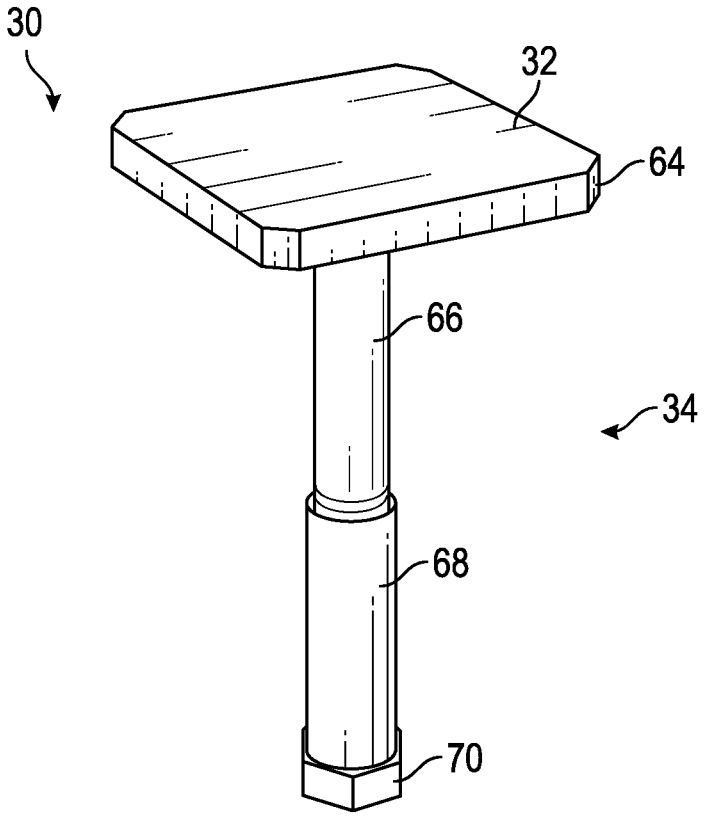
FIG. 4 is a perspective view of a lower assembly of the support in FIG. 1A in accordance with an embodiment of the present disclosure.

Referring now to FIG. 4, a perspective view of the lower assembly 30 is provided. The lower plate 32, like the upper plate, can include chamfered corners 64 between adjacent outer walls as well as an optional friction-reducing coating. The coupler 34 can include several components. In the depicted embodiment, the coupler 34 has a first bolt 66 extending from a bottom surface of the lower plate 32 where the first bolt 66 has a threaded outer surface. Then, the coupler 34 has a collar 68 with a first end with a threaded inner surface to match the first bolt 66. A second bolt 70 threads into an opposing, second end of the collar 68. The bolts 66, 70 and collar 68 can be rotated relative to each other to adjust the overall length of the coupler 34.

In some embodiments, a thread characteristic such as thread pitch is the same among the bolts 66, 70 and the collar 68. In other embodiments, the thread characteristic between the first bolt 66 and the first end of the collar 68 is different than the thread characteristic between the second bolt 70 and second end of the collar 68 so that the different thread characteristics result in different adjustments to the overall length of the coupler 34. Thus, one bolt can provide fine adjustment and one bolt can provide coarse adjustment. Further still, the thread characteristic can be thread handedness where one bolt has one handedness and the other bolt has an opposing handedness. In various embodiments, the coupler 34 has more or fewer than three components. In some embodiments, the coupler 34 is not adjustable and has a fixed length.

It will be appreciated that the overall length of the coupler 34 can be, at a minimum, greater than the height of the horizontal member of the frame plus the third distance between the horizontal member and the lower plate. Stated differently, the coupler 34 has a sufficient length such that when the wall panel is installed and the support is bearing part of the load, the coupler extends below, for instance, a bottom surface of the frame 6. Thus, the coupler 34 properly transfers the desired force to the floor surface.

Figure 5:
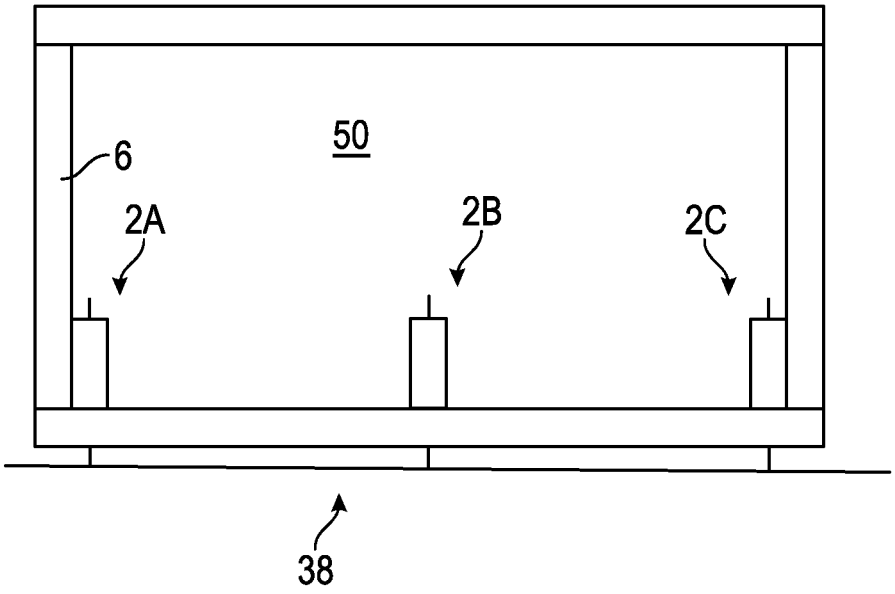
FIG. 5 is a front plan view of a wall panel with supports in accordance with an embodiment of the present disclosure.

Referring now to FIG. 5, a front plan view of a frame 6 with supports 2A-2C is provided. As discussed herein, a frame and/or a precast concrete façade wall panel 50 can include a plurality of supports, including more than the two supports. The supports 2A-2C are adjustable to impose a known force at multiple points on the floor surface 38. Thus, the supports 2A-2C can be individually adjusted to provide a desired distribution of a load from the wall panel 50 and frame 6 to the floor surface 38. It will be appreciated that the forces at each point of contact with the floor surface 38 can all be equal, can all be distinct, some can be equal while some are distinct, or any combination thereof to achieve the desired distribution of a load. While the supports 2A-2C in FIG. 5 are equally spaced from each other, it will be appreciated that various embodiments can include supports 2A-2C with other spacings to provide the desired distribution of a load. Moreover, the housing of each support 2A-2C, in various embodiments, can be connected to a horizontal member and/or a vertical member of the frame using, for instance, a welded connection.

Figure 6:
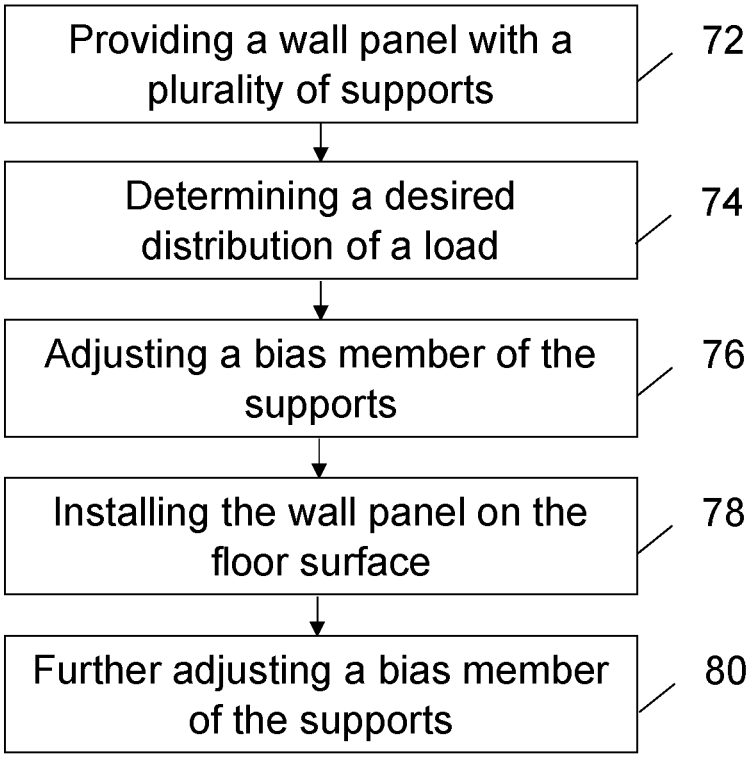
FIG. 6 is a flowchart showing a method of installing and adjusting a wall panel with a support in accordance with an embodiment of the present disclosure.

Referring now to FIG. 6, a flowchart depicting a method of distributing a load from a panel to a floor surface is provided. First, a façade wall panel is provided 72 with multiple supports. The supports contact the floor surface with couplers, and the force transferred through each coupler can be adjusted. Next, a desired distribution of a load from the panel to the floor surface is determined 74. This determination can be based on several factors, including the weight, size, and other characteristics of the wall panel itself. Moreover, when retrofitting an existing building with panels, the building may have requirements regarding the distribution of a load, for example, between columns. In addition, the building and its floor surfaces may have settled. Accordingly, a desired distribution is determined, such as a uniform distribution of the load from the wall panel to the floor surface.

Then, the supports are adjusted 76 to meet the desired distribution. In some embodiments, this means that a bolt for a given support is rotated to change the displacement of the bias member, either compressing or expanding the bias member, to change a force generated by the bias member and transferred through the coupler to the floor surface. With multiple bias members and possible distributions, the bias members can be adjusted in any number of ways relative to each other. In embodiments with two supports, the bias members may be adjusted to generate the same force or distinct forces. With three or more supports, in some embodiments, two supports may transfer the same force or distinct forces, and/or each support may transfer a distinct force.

After installing 78 the wall panel on the floor surface, the distribution may not be as desired. The measurements or characterizations of the floor surface or panel or support may not have been accurate. The distribution after installation can be determined by various sensors and/or displacements of various components. For example, the position of the bolt, and thus the upper plate, and the position of the coupler relative to a frame or housing, and thus the lower plate, can be assessed to determine the force that each bias member is transferring through each coupler to the floor surface. In further embodiments, one or more slots or windows are formed through one or more sidewalls of the housing. The slots or windows are configured to provide the ability to visually inspect the positions of one or more of the bolt 22, the upper plate 26, lower plate 32, and the position of the coupler 34 relative to the frame 6 or housing 4. Based on this assessment, further adjustments 80 can be made to the supports to reach the desired distribution. It will be appreciated that the actions depicted in FIG. 6 can be performed in any order. In addition, the present disclosure encompasses methods that include more or fewer actions than depicted in FIG. 6, in any combination.

The description of the present disclosure has been presented for purposes of illustration and description, but is not intended to be exhaustive or limiting of the disclosure to the form disclosed. Many modifications and variations will be apparent to those of ordinary skill in the art. The embodiments described and shown in the figures were chosen and described in order to best explain the principles of the disclosure, the practical application, and to enable those of ordinary skill in the art to understand the disclosure.

While various embodiments of the present disclosure have been described in detail, it is apparent that modifications and alterations of those embodiments will occur to those skilled in the art. Moreover, references made herein to "the present disclosure" or aspects thereof should be understood to mean certain embodiments of the present disclosure and should not necessarily be construed as limiting all embodiments to a particular description. It is to be expressly understood that such modifications and alterations are within the scope and spirit of the present disclosure, as set forth in the following claims.

What is claimed is:

1. An apparatus connected to a wall panel for adjusting a force against a floor surface, comprising:

a housing defining an interior volume and having an upper opening and a lower opening;

a bias member positioned within said interior volume between an upper plate of an upper assembly and a lower plate of a lower assembly;

a coupler of said lower assembly connected to said lower plate, wherein said coupler passes through said lower opening to contact said floor surface; and a bolt of said upper assembly that contacts said upper plate, wherein rotation of said bolt in a first direction moves said upper plate and compresses said bias member to increase said force transferred from said coupler to said floor surface, and rotation of said bolt in an opposing second direction moves said upper plate and expands said bias member to decrease said force transferred from said coupler to said floor surface.

2. The apparatus of claim 1, wherein said bias member is a spring having one of a linear response or a non-linear response.

3. The apparatus of claim 1, further comprising a bolt plate connected to said housing and covering said upper opening, wherein said bolt is threadably engaged to an aperture through said bolt plate so that said bolt can rotate in said first direction or said second direction.

4. The apparatus of claim 1, wherein said coupler comprises a first component threadably engaged to a second component, and relative rotation between said first and second components adjusts a length of said coupler and moves said lower plate within said housing.

5. The apparatus of claim 1, wherein said housing has a rectangular cross-section with four inner walls, and said upper plate and said lower plate each have four outer walls that complement said four inner walls of said housing.

6. The apparatus of claim 5, wherein said upper plate and said lower plate each have chamfers at corners between adjacent outer walls to reduce binding with said four inner walls of said housing.

7. The apparatus of claim 1, further comprising a guide that extends from a bottom surface of said upper plate and into said bias member to locate said bias member relative to said upper plate.

8. A system for distributing a load from a vertically-oriented wall panel to a floor surface, comprising:

a plurality of supports connected to a bottom end of said wall panel, each support having:

a bias member positioned within a housing, wherein said bias member generates a force equal to a portion of said load;

a coupler operably connected to said bias member, wherein said coupler contacts said floor surface to transfer said portion of said load to said floor surface; and an adjustment feature that changes said force generated by said bias member to change said portion of said load transferred to said floor surface, wherein said adjustment feature is a bolt that is threadably engaged with an aperture, and said bolt contacts an upper plate positioned at a top end of said bias member.

9. The system of claim 8, wherein said plurality of supports comprises at least three supports, and at least two supports of said plurality of supports transfer distinct portions of said load to said floor surface.

10. The system of claim 8, wherein said plurality of supports comprises at least three supports, and at least two supports of said plurality of supports transfer equal portions of said load to said floor surface.

11. The system of claim 8, further comprising a frame connected to said wall panel, wherein said plurality of supports is connected to said frame, and said coupler of each support in said plurality of supports extends through a horizontal member of said frame to contact said floor surface.

12. The system of claim 8, wherein said bias member is one of a spring, a hydraulic actuator, a pneumatic actuator, or an electric actuator.

13. The system of claim 8, wherein said bias members of said supports of said plurality of supports are adjusted such that said load from said wall panel is uniformly distributed to said floor surface.

14. A method for distributing a load from a wall panel that is vertically-oriented against a floor surface, comprising:

providing said wall panel comprising a plurality of supports connected to a bottom end of said wall panel, wherein each support has:

a bias member positioned within a housing, wherein said bias member generates a force equal to a portion of said load;

a coupler operably connected to said bias member, wherein said coupler extends to contact said floor surface to transfer said portion of said load to said floor surface;

an adjustment feature that changes said force generated by said bias member to change said portion of said load transferred to said floor surface, wherein said adjustment feature is a bolt that is threadably engaged with an aperture, and said bolt contacts an upper plate positioned at a top end of said bias member;

positioning the bias member between the upper plate and a lower plate of each support of said plurality of supports, wherein said coupler is connected to said lower plate;

determining a distribution of said load from said wall panel to said floor surface based on a characteristic of said floor surface; and moving said upper plate relative to said lower plate of at least one support of said plurality of supports to change a displacement of said bias member and adjust said force generated by said bias member to meet said determined distribution of said load.

15. The method of claim 14, further comprising:

rotating the bolt relative to a bolt plate of a support of said plurality of supports to move said upper plate relative to said lower plate.

16. The method of claim 15, further comprising:

fixing a position of said bolt relative to said bolt plate of said support of said plurality of supports to maintain said force generated by said bias member.

17. The method of claim 14, further comprising:

rotating a first component of said coupler of a support of said plurality of supports relative to a second component of said coupler to change a length of said coupler and to change a position of said lower plate.

18. The method of claim 14, further comprising:

connecting at least three supports of said plurality of supports to said wall panel, wherein at least two supports transfer distinct portions of said load.

19. The method of claim 14, further comprising:

connecting at least three supports of said plurality of supports to said wall panel, wherein at least two supports transfer equal portions of said load.

* * * * *